United States Patent [19]

Salkeld et al.

[11] Patent Number: 4,925,129

[45] Date of Patent: May 15, 1990

[54] MISSILE DEFENCE SYSTEM

[75] Inventors: David Salkeld; John W. Schofield, both of Stevenage, United Kingdom

[73] Assignee: British Aerospace public limited company, London, England

[21] Appl. No.: 41,125

[22] Filed: Apr. 16, 1987

[30] Foreign Application Priority Data

Apr. 26, 1986 [GB] United Kingdom ..... 8610291

[51] Int. Cl.[5] ..... F41G 7/30

[52] U.S. Cl. ..... 244/3.11; 244/3.14

[58] Field of Search ..... 244/3.11, 3.14, 3.15, 244/3.16

[56] References Cited

U.S. PATENT DOCUMENTS 3,156,435 11/1964 Norton et al. ..... 244/3.14

3,260,478 7/1966 Welti ..... 244/3.14

3,286,955 11/1966 French et al. ..... 244/3.14

3,741,502 6/1973 Schroader et al. ..... 244/3.14

*Primary Examiner*—Charles T. Jordan

*Attorney, Agent, or Firm*—Nixon & Vanderhye

[57] ABSTRACT

A missile defence system for guiding a sub-projectile to intercept and destroy a target includes a radar tracker to acquire and track the target, predictor means for determining the predicted track of the target, and a guided projectile for being guided onto a rear reciprocal track of the target. The guided projectile includes an optical tracker for acquiring and tracking the target at relatively small distances and a sub-projectile for being guided onto the line of sight connecting the optical tracker and the target thereby to intercept and destroy the target.

12 Claims, 2 Drawing Sheets

MISSILE DEFENCE SYSTEM

BACKGROUND OF THE INVENTION

This invention relates to a missile defence system for intercepting targets and in particular, but not exclusively, to a system for intercepting and destroying a ballistic missile after it has re-entered the earth's atmosphere.

Considering the design of an anti-ballistic missile system, the primary threat is assumed to come from re-entry vehicles approaching on ballistic trajectories aimed with sufficient accuracy to endanger point targets—such as, for example, airfields or ports—but which are likely to be making small manouvres, either deliberately or inadvertantly, about the mean ballistic path. The disclosed embodiment of this invention is concerned with providing a means of intercepting this threat with projectiles with sufficient energy to ensure destruction of the re-entry vehicles, and accurate enough to achieve direct hits on their warheads.

In this specification the term "near reciprocal track" is used to mean a trajectory which lies on or near the reciprocal of the predicted track of a target.

The term 'optical tracker' is used to define trackers working at optical wavelengths (one or more of U.V., visible and IR radiation) and similar terms throughout the specification should be interpreted accordingly.

SUMMARY OF THE INVENTION

According to one aspect of the present invention, there is provided a missile defence system for intercepting a target, said system comprising:- a radar tracker for tracking a target at relatively large distances;

target track predictor means for receiving data output by said radar tracker to determine a predicted track of said target;

a guided projectile including at least one sub-projectile launchable from said projectile and optical tracker means for tracking the target at relatively small distances;

projectile guidance processing means for processing the output of said target track predictor means and for issuing guidance commands to guide the projectile onto a near reciprocal track; and sub-projectile guidance processing means for processing the output of said optical tracker means and for issuing guidance commands to guide the sub-projectile to intercept said target.

When the above system is used to intercept and destroy a re-entry vehicle on a ballistic trajectory, the re-entry vehicle will initially be acquired and tracked by the radar tracker at long distance—typically tens of kilometers in altitude—to establish the predicted track of the re-entry vehicle. Once the predicted track has been established—even to a very rough approximation—the projectile is launched to fly onto a near reciprocal track of the target. When the projectile reaches a predetermined point along the near reciprocal track, the re-entry vehicle is acquired and tracked by the optical tracker and one or more sub-projectiles are then launched and guided to intercept the re-entry vehicle. The unexpected benefit of this system is that it allows the different benefits of radar and optical tracking systems to be combined to provide a fast and highly accurate defence system. Radar systems are capable of tracking targets at long range but lack the accuracy required to allow a missile to be guided to intercept a target. Conversely, an optical tracker is usually incapable of tracking at long distances and may be rendered ineffective by cloud cover or atmospheric distortion. An optical tracker can provide sufficient accuracy to guide a projectile to intercept and destroy a target. In this invention the inventors have provided a remarkable system which flies in the face of conventional understanding of systems insofar as it allows fast moving targets of relatively, small size to be intercepted in a "direct hit" several tens of miles away from the projectile launch site.

Moreover, the system predicts the track of the incoming target and causes the projectile to fly up the reciprocal track; this reduces the amount of manouvring required of the sub-projectile.

Furthermore, because the system makes it possible for the sub-projectile to be guided to intercept the incoming target, the target may be destroyed or disabled by a kinetic energy kill, without using explosives.

In one arrangement, the radar tracker is earth-based and sufficiently accurate to acquire and track a re-entry vehicle at high altitudes, and the sub-projectiles are launched when the projectile is on a near reciprocal track (as hereinbefore defined) of the re-entry vehicle at a height above the clouds where the optical tracker can acquire and track the re-entry vehicle.

It is advantageous for the sub-projectile guidance processing means to implement a line-of-sight guidance algorithm, for this form of guidance considerably reduces the amount of lateral acceleration required of the sub-projectile. It can be shown that the lateral acceleration required of the projectile is limited to the lateral acceleration of the re-entry vehicle; this enables sub-projectiles of relatively modest latax capability to be used. An advantage of using an optical tracker is that automatic target tracking at optical wavelengths provides high quality line-of-sight data which enables simple, non-instrumented sub-projectiles with line-of-sight guidance to achieve accuracies sufficient for direct hits on small manouvreing re-entry vehicle targets.

Preferably, the system includes a further radar for tracking the projectile and for providing a command link for transmitting guidance commands output by said projectile guidance processing means to said projectile.

Advantageously, said projectile is provided with a transponder for receiving signals from said further radar and which includes steerable antenna means for locking on to and tracking the transmissions from said further radar and sensor means for measuring the attitude of the antenna means with respect to said projectile. In this arrangement the direction of the projectile in space axes may be measured by said further radar and the attitude of the antenna relative to the projectile body axes may be measured so that the body direction of the projectile in space axes may be determined. From this information, the optical tracker on the projectile may be pointed in the appropriate spatial direction so as to acquire the re-entry vehicle target initially.

DESCRIPTION OF FIGURES

By way of example only, an embodiment of ballistic missile defence system incorporating features of this invention will now be described in detail with reference to the following drawings in which.

DESCRIPTION OF PREFERRED EMBODIMENTS

The particular embodiment of the system illustrated is intended to intercept and destroy, by a direct hit kinetic energy kill, re-entry vehicles targeted on a particular point (e.g. an airfield or a port) target and approaching on a ballistic or suppressed ballistic trajectory.

Figure 1:
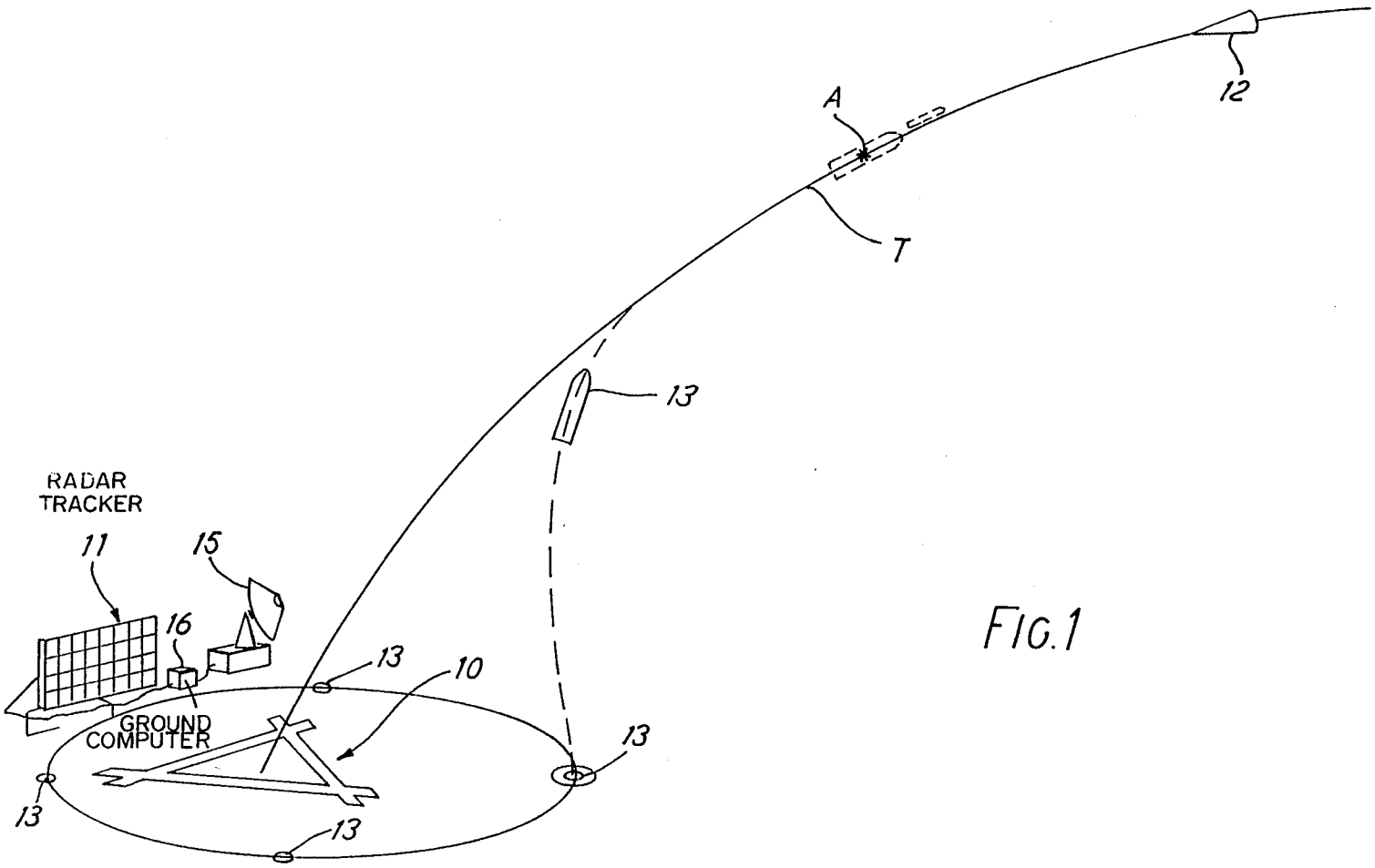
FIG. 1 is a schematic illustration representing the overall geographic layout of the system.

Referring to FIG. 1 there is illustrated a defended point target 10, defended by a ballistic missile defence system. The system in broad detail comprises a primary radar tracker 11 for acquiring and tracking a re-entry vehicle 12, four launch sites each containing a bus projectile 13 carrying three sub-projectiles 14, a secondary radar 15 for acquiring and tracking the bus projectile and a ground computer 16 for receiving re-entry vehicle directional data and bus directional data and for generating guidance and control commands to be transmitted to the bus projectile.

The primary radar tracker 11 includes a phased array antenna and is of sufficient sensitivity and power to enable re-entry vehicle 12 to be acquired and tracked at distances around 100 km from the defended point. The system may receive early warning data from other sources to assist initial acquisition of the re-entry vehicle. The secondary tracker radar 15 is of high accuracy but does not need to have such a large power and sensitivity for it needs at most to track the bus projectile 13 only as far as an intercept point with the re-entry vehicle. The output data from the primary and secondary tracker radars are supplied to the ground computer 16 which predicts the trajectory of the re-entry vehicle 12 and calculates guidance commands for transmission to the bus projectile to guide it on to a near reciprocal trajectory.

Figure 2:
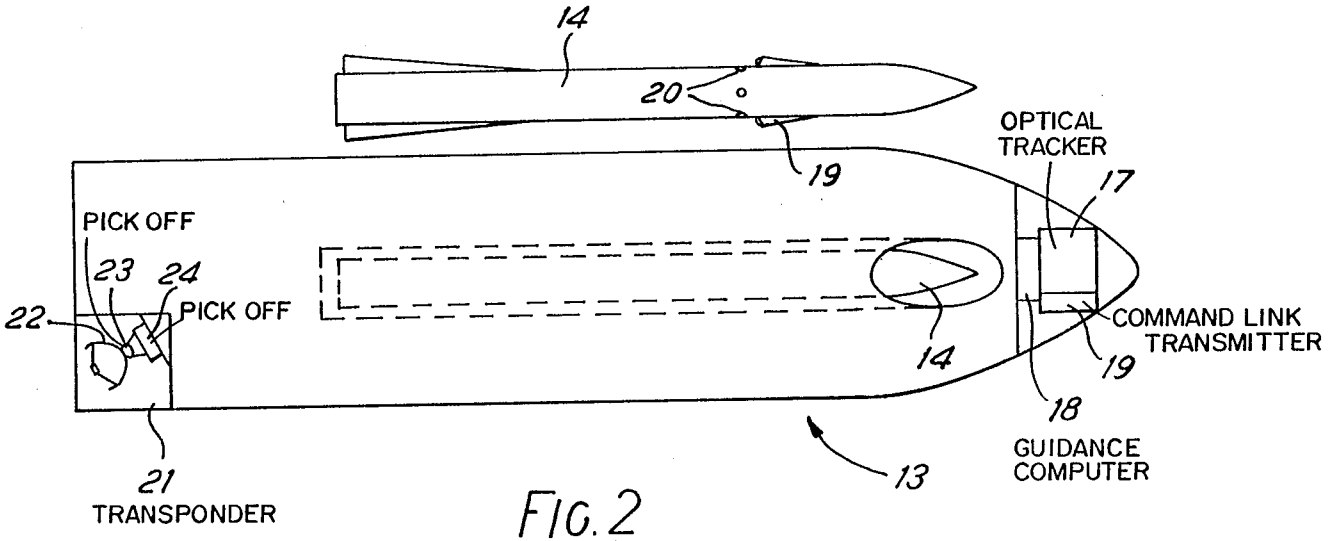
FIG. 2 is a schematic illustration of a bus projectile forming part of the system, with a sub-projectile shown removed from its launcher tube.

The bus projectile 13 is propelled by known methods, for example by a rocket motor and incorporates three launchers (only one of which is shown in FIG. 2) each housing a sub-projectile 14. The bus projectile 13 also includes a stabilised optical tracker 17 for tracking the re-entry vehicle and, optionally, a sub-projectile, and the elements necessary for implementing line of sight guidance for the sub-projectile. These elements include a guidance computer 18 for receiving directional data for the sub-projectile and the re-entry vehicle, and a command link transmitter 19 for transmitting guidance commands to the sub-projectile. The sub-projectile incorporates a command link receiver 19' for receiving the guidance command, and actuators 20 for implementing the guidance commands. As an alternative, a laser information field system or a beam rider system may be used without affecting the principle.

The bus projectile also includes an R.F. transponder 21 via which the bus projectile is tracked by the secondary radar on the ground. The guidance commands generated by the ground computer are also transmitted to the bus projectile by means of the secondary radar.

The transponder 21 on the bus projectile is provided with a steerable antenna 22 which is made to lock-on and track the transmissions from the secondary radar. The direction of the bus projectile in space axes is measured by the secondary radar and these angular data are transmitted to the bus projectile via a ground to air bus projectile command link. Pick offs 23, 24 on the steered antenna measure its direction in terms of the body axes of the bus projectile. From these data and the angular data from the ground, the bus projectile determines its body directions in space axes. When the body direction of the bus projectile in space axes is known, the stabilised optical tracker 17 is pointed in the appropriate spatial direction to initially acquire the re-entry vehicle 12. The estimates of the direction of the re-entry vehicle determined by the optical tracker are then passed via the bus projectile command link to the ground computer to enable it to refine its estimates of re-entry vehicle position and motion.

In use, the presence of an incoming re-entry is detected and signalled to the system by an early warning system (not shown). The primary radar 11 is then operated to acquire the target re-entry vehicle 12 and to track it. The tracking data is supplied to the ground computer which estimates the predicted track "T" of the re-entry vehicle. The computer 16 also calculates point "A" the target acquisition point. Point "A" is a point on the near reciprocal track which is above cloud cover and at which the optical tracker 17 in the projectile 13 is capable of reliably acquiring and tracking the re-entry vehicle. The selection of point "A" will therefore depend, inter alia on the track and velocity of the re-entry vehicle, the velocity of the projectile 13 and the maximum operating range of the optical tracker 17. Having determined point "A" the computer initiates launch of one of the projectiles 13 and provides the projectile 13 with guidance commands via the secondary radar tracker 15 to guide the projectile to point "A". As the projectile travels to point "A", further tracking data will be supplied by primary radar tracker 11 to the ground computer, and the computer processes this data to obtain an improved estimate of point "A" and commands the projectile 13 accordingly. At some distance before point "A" the ground computer initiates acquisition of the re-entry vehicle by the stabilised optical tracker 17, instructing the tracker of the appropriate acquisition direction using data concerning the body direction in space axes of the bus projectile generated and supplied as explained previously. When the projectile reaches point "A" one or more of the sub-projectiles are launched and guided by means of a line of sight guidance law to collide head on with the re-entry vehicle and to disable it by a direct hit kinetic energy kill.

The guidance system may advantageously incorporate the features disclosed in our co-pending U.S. patent application No. 925,257 filed Oct. 31, 1986 and assigned to the assignee of the present invention.

In the above arrangement it will be noted that the accuracies of line of sight guidance can be enjoyed:

(i) at ranges from the ground launch site far in excess of the normal limits of such guidance systems, and (ii) at altitudes above the cloud ceiling, thus enabling optical sensors to be used for target acquisition and tracking.

Also, since a line of sight guidance law is employed the system requires only modest lateral acceleration capabilities.

The system allows a direct hit, kinetic energy kill mechanism for defeating re-entry vehicle warheads, thus obviating any need for high explosive or nuclear warheads.

The system also employs a ground air tracking system which serves three roles:

(i) it provides a secondary radar for tracking the bus projectiles;

(ii) It provides a command and data link between the ground station and the bus projectile, and (iii) it provides a navigational system which enables the bus projectile to determine its body pointing direction.

What is claimed is:

1. A missile defence system for intercepting a target, said system comprising:

a radar tracker for tracking a target at relatively large distances;

target track predictor means for receiving data output by said radar tracker to determine a predicted track of said target;

a guided projectile including at least one sub-projectile launchable from said projectile and optical tracker means for tracking the target at relatively small distances;

projectile guidance processing means for processing the output of said target track predictor means and for issuing guidance commands to guide the projectile onto a near reciprocal track; and sub-projectile guidance processing means for processing the output of said optical tracker means and for issuing guidance commands to guide the sub-projectile to intercept said target.

2. A missile defence system as claimed in claim 1, wherein said sub-projectile guidance processing means issues guidance commands to command the sub-projectile onto the line-of-sight interconnecting said optical tracker and said target.

3. A missile defence system as claimed in claim 1, wherein said system further comprises a further radar tracker for tracking said projectile.

4. A missile defence system as claimed in claim 1 wherein said system further comprises a further radar tracker for tracking said projectile and for transmitting guidance command output by said projectile guidance means to said projectile.

5. A missile defence system as claimed in claim 4, wherein said projectile includes steerable directional antenna means for locking on to and tracking the transmissions from said further radar tracker and sensor means for measuring the attitude of said antenna means with respect to said projectile.

6. A missile defence system as claimed in claim 5, wherein said system includes means responsive to data from said further radar representative of the direction of said projectile in space axes and data from said sensor means representative of the attitude of the antenna relative to the projectile body axes thereby to determine data representative of the body direction of the projectile in space axes.

7. A missile defence system as claimed in claim 6, wherein said system includes means responsive to said body direction data and data representative of the estimated position of said target thereby to calculate the heading of the target relative to said projectile.

8. A missile defence system as claimed in claim 1, wherein said radar tracker comprises a phased array antenna.

9. A missile defence system according to claim 1, wherein said projectile includes a plurality of sub-projectiles.

10. A missile defence system according to claim 1, wherein said system includes a plurality of projectile launch sites disposed around a defended point and said target track predictor means determines an appropriate ballistic or suppressed ballistic trajectory interconnecting the sensed position of said target and the defended point in accordance with the sensed path of the target.

11. A missile defence system according to claim 1, wherein means are provided to supply said systems with early warning data.

12. A missile defence system for guiding a missile to intercept a target, said system comprising:

means for tracking said target;

a projectile for being guided to intercept said target;

a guidance computer for providing guidance data for said projectile;

a radar tracker for tracking said projectile and for outputing to said guidance computer, data representing the location of said projectile relative to said radar tracker in space axes and for transmitting said projectile guidance data and for receiving from said projectile control data;

a directional antenna means provided on said projectile for receiving guidance data and for transmitting control data; and means, associated with said directional antenna means, for generating control data representing the direction of arrival of said guidance data from said radar tracker relative to the body axes of said projectile and for transmitting said control data to said radar tracker, whereby said guidance computer is supplied with control data representing the heading and attitude of said projectile.

* * * * *